US006371144B1

(12) United States Patent
Ragatz

(10) Patent No.: US 6,371,144 B1
(45) Date of Patent: Apr. 16, 2002

(54) CAR TENT

(75) Inventor: Jeffrey C. Ragatz, Middleton, WI (US)

(73) Assignee: Capital Concepts, LLC, Middleton, WI (US)

( * ) Notice: Subject to any disclaimer, the term of this patent is extended or adjusted under 35 U.S.C. 154(b) by 0 days.

(21) Appl. No.: 09/541,997

(22) Filed: Apr. 3, 2000

(51) Int. Cl.[7] ..... E04H 15/42

(52) U.S. Cl. ..... 135/156; 135/124; 135/115; 135/88.13; 446/478; 296/136; D21/836; 150/166

(58) Field of Search ..... 135/156, 114, 135/115, 116, 117, 121, 124, 93, 905, 137, 88.01, 88.13; 296/136; 446/471, 478; 150/154, 166; D21/834, 836, 838, 839; D12/401–404; D6/597

(56) References Cited

U.S. PATENT DOCUMENTS

| | | | | |
|---|---|---|---|---|
| 1,472,651 | A | * 10/1923 | Holling | 135/115 |
| 2,688,513 | A | * 9/1954 | Poirier | 135/115 |
| 3,168,101 | A | 2/1965 | Porter | |
| 3,547,136 | A | * 12/1970 | Munich et al. | 135/156 |
| 4,077,417 | A | * 3/1978 | Beavers | 135/117 X |
| 4,332,265 | A | * 6/1982 | Baker | 135/88.13 |
| D267,811 | S | 2/1983 | Grebe | |
| 4,556,391 | A | * 12/1985 | Tardivel et al. | 446/478 X |
| 4,827,958 | A | 5/1989 | Cantwell et al. | |
| 5,261,436 | A | 11/1993 | Funk | |
| D361,364 | S | 8/1995 | Winters | |
| 5,512,002 | A | 4/1996 | Lieberman | |
| 5,560,385 | A | 10/1996 | Zheng | |
| 5,603,185 | A | * 2/1997 | Murphy | 446/220 X |
| 5,732,726 | A | 3/1998 | Lee | |
| 5,761,852 | A | 6/1998 | Liu | |
| D396,087 | S | 7/1998 | Liu | |
| 5,893,238 | A | 4/1999 | Peacock et al. | |
| D417,481 | S | 12/1999 | Schwartz et al. | |
| D428,961 | S | 8/2000 | Orphan et al. | |
| D430,638 | S | 9/2000 | Allen | |
| 6,202,666 | B1 | * 3/2001 | Rehbein | 135/115 |

OTHER PUBLICATIONS

A brochure form "Bed Bath & Beyond", p. 26, Nov. 1999.*
"Richard Petty Driving Experience . . . "—Nascar Illustrated—Jan. 2000—pp. 13 & 14.
"Checker Auto Parts/Dura–Lube 500k"—Nascar Illustrated—Jan. 2000—pp. 85 & 86.
"Dale Earnhardt, Jr."—Nascar Illustrated—Jan. 2000.
"MSD Motorsport Direct© Racing Collectables"—Nascar Illustrated—Jan. 2000—p. 39.
"Nascar Racers"—Action Racing Collectables, Inc.—Nascar Illustrated—Jan. 2000—p. 25.
"Article by Ben White showing picture of Du Pont race car"—Nascar Illustrated—Jan. 2000.

* cited by examiner

*Primary Examiner*—Carl D. Friedman
*Assistant Examiner*—Winnie Yip
(74) *Attorney, Agent, or Firm*—Lathrop & Clark LLP

(57) ABSTRACT

A tent having the overall appearance and shape of a NASCAR vehicle has fabric suspended between two sections of flexible pipe manufactured from PVC or fiberglass. The flexible tube sections cross forming two gentle smooth curves which when viewed from above form a flattened X. The bottom panel of the tent is a rectangle which has two parallel long sides and two parallel short sides and which may be staked to the ground. Two sides extend upwardly from the two long sides of the rectangle, and have the appearance of the sides of an automobile. The front bumper, the hood, the front windshield, the car top, the back window, rear spoiler and the rear bumper are formed by a panel which is joined to the tent bottom and the tent sides having printed indicia thereon representative of the various automotive parts. The driver's side of the car has a door formed by a zipper. A screen flap within the door forms an inner screen door. Additional ventilation is provided by screen panels which underlie flaps forming the front and rear windshields.

19 Claims, 3 Drawing Sheets

CAR TENT

CROSS REFERENCES TO RELATED APPLICATIONS

STATEMENT AS TO RIGHTS TO INVENTIONS MADE UNDER FEDERALLY SPONSORED RESEARCH AND DEVELOPMENT

BACKGROUND OF THE INVENTION

The present invention relates to tents in general and to exteriorly supported tents in particular.

The use of a tent as a place of abode probably predates human history. Even today some nomadic peoples continue to dwell in tents. Tents invoke images which are romantic and exciting, conjuring up images of Arabian Nights, Mongolian Hordes, and Native American villages. Even the uses to which tents are put in modern Western society, such as camping, exploring, military deployments, circuses, and outdoor parties, convey a sense of excitement. Undoubtedly it is because of both historical and modern uses of tents that they attract the imagination of children. Thus tents designed as toys for children have been developed.

A children's tent may advantageously be designed to depict a covered wagon, a car or other vehicle. A tent in the shape of a vehicle has both the excitement associated with a small dwelling place and the excitement inherent in vehicles. Despite the many exciting possibilities of children's tents, their appeal could be greatly increased if they could be linked to an aspect of popular culture.

SUMMARY OF THE INVENTION

The children's play tent of this invention has the overall appearance and shape of the NASCAR vehicle. The tent is suspended between two sections of flexible pipe manufactured from PVC or fiberglass. The flexible tube sections cross, forming two gentle smooth curves which viewed from above form a flattened X. The ends of the rods or flexible pipes can fit into four pockets at the corners of the bottom on the tent, or they may be staked into the ground outwardly of, and away from the corners of the bottom. The bottom on the tent is a rectangle which has two parallel long sides and two parallel short sides. The bottom of the tent may be staked to the ground by eight loops. The tent has two sides which extend upwardly from the two long sides of the rectangle, the sides of the tent having the appearance of the sides of an automobile. The front bumper, the hood, the front windshield, the car top, the back window, rear spoiler and the rear bumper are formed by a single panel which is joined to the tent bottom and the tent sides. The driver's side of the car has a door formed by a zipper. A screen flap within the door forms a second screen door. Additional ventilation is provided by screen panels which underlie flaps forming the front and rear windshields.

It is an object of the present invention to provide a tent for children which has the shape of a car.

It is another object of the present invention to provide a tent which maybe made to look like a NASCAR vehicle.

It is a further object of the present invention to provide a tent on which advertising slogans and labels may be placed.

It is a yet further object of the present invention to provide a children's tent which can be used both indoors and outdoors.

It is a still further object of the present invention to provide a tent which can be used for play and for camping.

It is also an object of the present invention to provide a tent which is simply exteriorly supported.

Further objects, features and advantages of the invention will be apparent from the following detailed description when taken in conjunction with the accompanying drawings.

DESCRIPTION OF THE PREFERRED EMBODIMENTS

Figure 1:
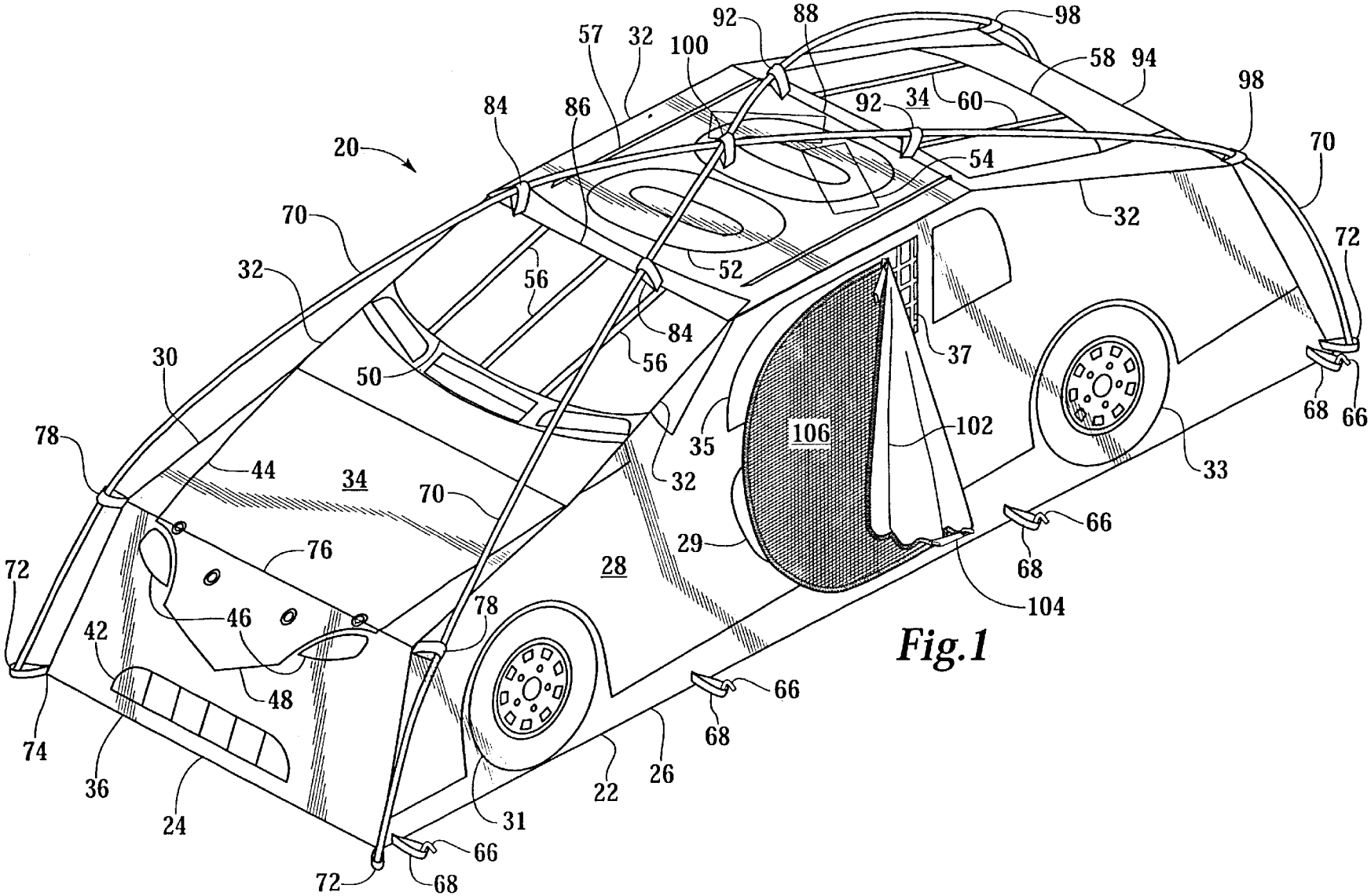
FIG. 1 is an isometric view of the children's tent of this invention.
Figure 2:
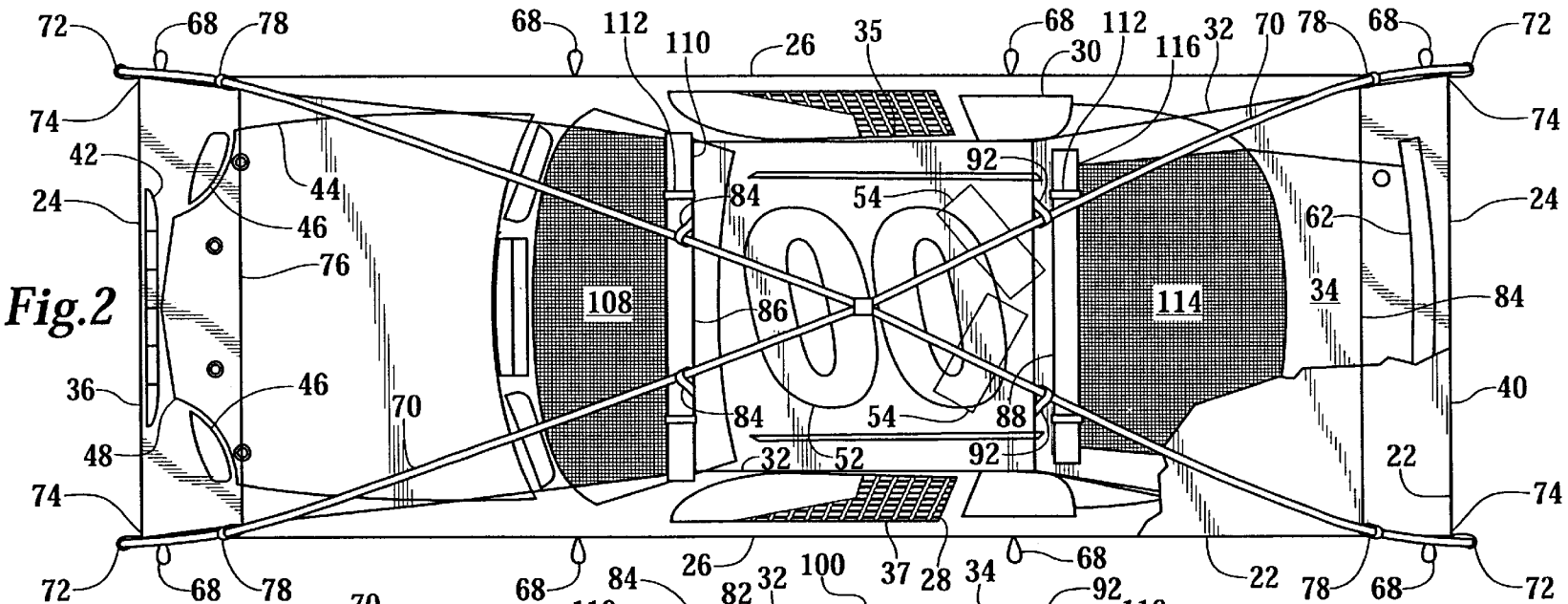
FIG. 2 is a top plan view partially cut away of the children's tent of FIG. 1.
Figure 3:
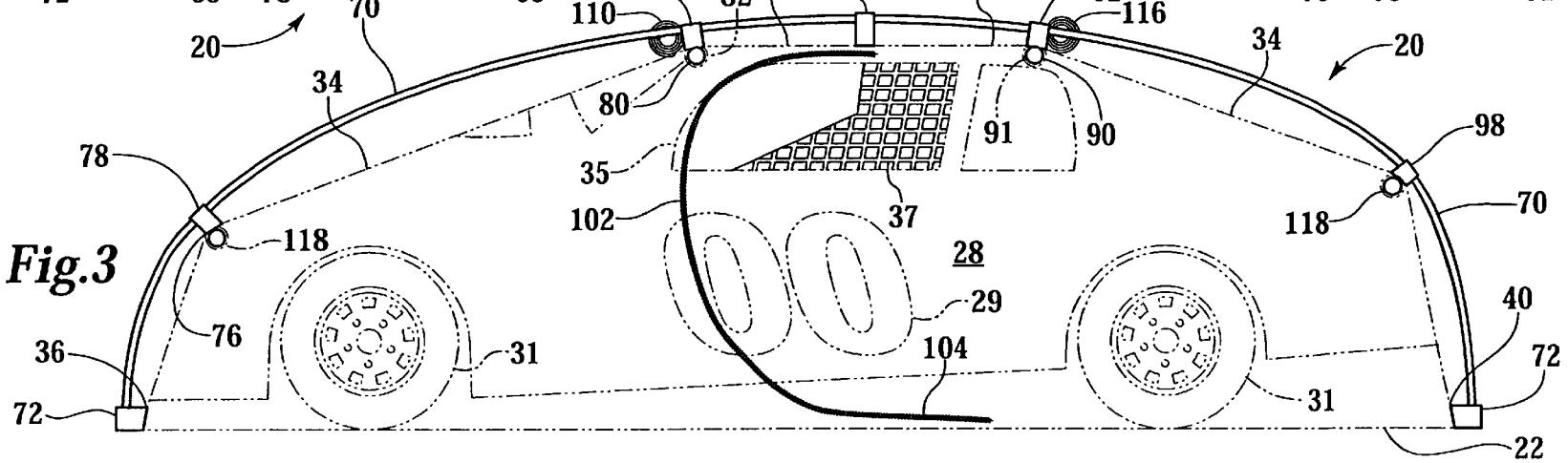
FIG. 3 is a side elevational view of the children's tent of FIG. 1

Referring more particularly to FIGS. 1–4 wherein like numbers refer to similar parts, a children's tent 20 is shown in FIGS. 1–3. The tent 20 has a rectangular bottom which formed by a bottom panel 22 which has two short sides 24 and two long sides 26. Extending upwardly from the long sides 26 are a driver's-side side panel 28, and an opposite side panel 30. The side panels 28, 30 have upwardly extending edges 32 which are sewn to a top panel 34. The side panels 28, 30 are printed with indicia to resemble the sides of a car.

The indicia printed on the sides 28, 30 of the car 20 include front racing wheels 31, rear racing wheels 33, side windows 35, and on the driver's-side side panel 28, a safety net 37. On both sides 28, 30 a large indicia 29 of a numeral between zero and nine hundred ninety-nine is positioned between the racing wheels 31, 33. The panels making up the tent may be constructed of cloth or any other material from which tents are conventionally made.

The top panel 34 extends from the front 36 of the tent 20 where it is attached along the front short side 24 of the bottom panel 22, and extends along, and is joined to, the upwardly extending edges 32 of the side panels 28, 30. The top panel 34 extends along the side panels joined to the upwardly extending edges 32 until it terminates at the rear 40 of the tent 20 along the rear short side 24 of the bottom panel 22. The top panel 34 is imprinted with indicia, starting with an air intake 42 adjacent the bottom panel front short side 24, followed by the outline of the hood 44, headlights 46, grill 48, front windshield 50, roll bar supports 56, racing designation number 52, air spoilers 54, rear window 58 rear roll bar supports 60, rear spoiler 62.

The top panel 34 is thus joined to the short sides 24 of the bottom panel 22 and the upwardly extending edges 32 of the side panels 28, 30 to form the body of the tent 20. The bottom panel 22 of the tent 20 is staked to the ground by eight stakes 66 which pass through strap loops 68 sewn along the rectangular bottom 22 of the tent 20. As best shown in FIG. 2, the tent 20 is supported by a pair of flexible tent poles 70 which extend between tent pole pockets 72 located at each of four corners 74 defined by the rectangular bottom panel 22. The tent poles 70 cross over the top of the portion of the top panel 34 which forms the roof 57 of the car depicted by the tent 20. The tent poles 70 are formed of flexible fiberglass, or PVC pipe. The poles 70 extend diagonally between diagonally opposite corners 74 of the bottom panel 22.

A fold line 76 is defined and supported by two cloth loops 78 which are supported by the flexible tent poles 70 and attached between the upwardly extending edge of the side panels 28, 30 and the top panel 34. The fold line 76 marks the transition from the front bumper of the car to the hood. A first side-to-side support member 80 is located in a pocket 82 formed where the front windshield 50 meets the car roof 57. Two strap loops 84 are located above the side-to-side support member 80 and support a fold line 86 marking the transition from the front windshield 50 to the roof 57.

A fold line 88 is defined between the roof 57 and the rear window 58 and is supported by a second side-to-side support member 90 received within a pocket 91. Again, two strap loops 92 are located above the second side-to-side support member 90, and support the tent and the member 90 from the crossed tent poles 70. Finally, a fold line 94 is formed between the rear spoiler 54 and the rear bumper 96. Two long loops 98 support the fold line 94 on the flexible tent poles 70. A centrally located cloth loop 100 on the roof 57 supports the tent poles 70 where they cross.

As shown in FIG. 1, entrance to the tent is gained through a door 102 formed by a zipper 104. An inner screen door 106 is positioned interior to the door 102, and the screen door is also closed by a zipper (not shown).

Ventilation within the tent 20 is provided by a front screen window 108 which is covered by a flap 110 which may be rolled up as shown in FIG. 2 and FIG. 3 and held in place by Velcro straps 112. In a similar way, a rear screen window 114 is covered by a flap 116 also shown rolled up in FIG. 2 and FIG. 3, and held in place by Velcro straps 112.

Figure 4:
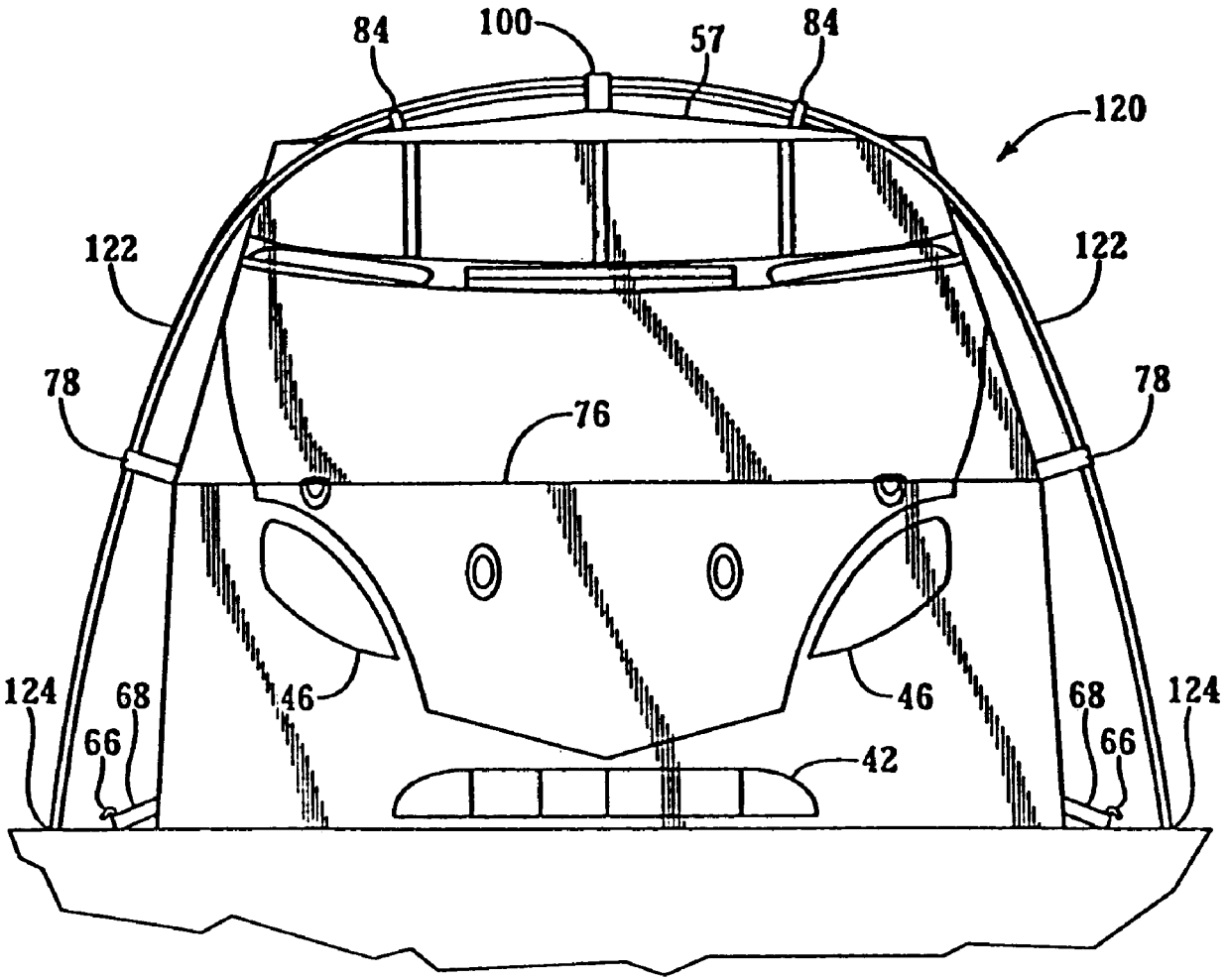
FIG. 4 is a front elevational view of an alternative embodiment of the tent of this invention.

An alternative embodiment tent 120 is shown in FIG. 4. In the tent 120, the ends of tent poles 122 are staked directly into the ground at points 124 along a diagonal line formed by extending the rectangular bottom diagonals. In this way, the tent poles 70 are substantially outboard of the tent as they cross the front bumper fold line 76 and the rear bumper fold line 94, thus placing tension on the fold lines 76, 94. By staking the tent poles 70 directly into the ground, the curve of the tent poles assumes a more gradual parabolic shape.

On the other hand, by placing the flexible tent poles 70 in pockets 72 attached to the corners 74 of a rectangular bottom 22, as shown in the embodiment of FIGS. 1–3, it is possible to pitch the tent indoors, or outdoors on concrete or blacktop. Placement of the flexible tent poles 70 in pockets 72 may require additional side-to-side support members 118 extending between the support loops 78 and the support loops 98, as shown in FIG. 3, similar to the side-to-side support members 80, 90 which support the roof 57.

It should be understood that wherein the number "00" is shown printed on the sides and roof of the car depicted by the tent 20, typically a number between one and ninety-nine, but more recently three digit numbers are being used to designate a particular NASCAR driver. The height of the characters making up the car number are typically one-half or more of the width of the car top.

It should be understood that where the indicia is indicated as being printed on the panels making up the tent it will be understood that printing includes but is not limited to silkscreen printing, other printing methods, as well as other marking techniques such as weaving, embossing, embroidering, and applique.

It should be understood that a rain shield may be fastened over the tent poles 70 to increase the tent's resistance water infiltration during a rainstorm. Such a rain shield arrangement and construction will be understood by those skilled in the art.

It is understood that the invention is not limited to the particular construction and arrangement of parts herein illustrated and described, but embraces such modified forms thereof as come within the scope of the following claims.

I claim:

1. A tent simulating the appearance of an automobile comprising:

a rectangular bottom panel having two long parallel sides and two short parallel sides, and four corners;

two side panels, each side panel attached to one of the long parallel sides of the bottom panel, each side panel having an upwardly extending peripheral edge, each side panel having indicia thereon giving the appearance of two wheels spaced apart and adjacent to the bottom panel, between said wheels a large number between zero and nine hundred ninety-nine and above said number, indicia depicting a window;

a top panel connected to each of the short parallel sides of the rectangular bottom panel, the top panel connected to the peripheral edge of each of the side panels, the top panel forming regions simulative of a forward bumper, a hood, a front window, a car top, a back window, and a rear bumper, the top panel having indicia printed thereon depicting a front windshield, a rear windshield, and a large number between zero and 99 printed between the front windshield and the rear windshield;

a first flexible pole extending between a first pocket positioned adjacent to a first corner of said four corners, and extending to a second pocket adjacent to a second corner of said four corners which is positioned opposite the first corner along a diagonal of the rectangular bottom panel;

a second flexible pole crossing over the first flexible pole and extending between a third pocket positioned adjacent to a third corner of said four corners, and extending to a fourth pocket adjacent to a fourth corner of said four corners which is positioned opposite to the third corner along a diagonal of the rectangular bottom; and a plurality of attachments extending between the first and second flexible poles and the tent to support the tent in the shape of a car wherein the first flexible pole and the second flexible pole form two gentle smooth curves which viewed from above form a flattened X; and a plurality of spaced apart side-to-side support members, the support members positioned within pockets formed in the top panel, the plurality of side-to-side support members positioned beneath individual attachments of the plurality of attachments.

2. The tent of claim 1 wherein one of the side panels has a door formed by a zipper.

3. The tent of claim 2 further comprising a screen panel positioned behind the door.

4. The tent of claim 1 wherein a portion of the top panel underlying the indicia indicating the front window is constructed of a screen material.

5. The tent of claim 4 further comprising a rain flap which extends down over the portion of the top panel constructed of screen material, the indicia indicating the front window being printed on the rain flap.

6. The tent of claim 1 wherein a portion of the top panel underlying the indicia indicating the rear window is constructed of a screen material.

7. The tent of claim 6 further comprising a rain flap with extends down over the portion of the top panel constructed of screen material, the indicia indicating the rear window being printed on the rain flap.

8. A tent simulating the appearance of an automobile comprising:

a rectangular bottom panel, having two long parallel sides and two short parallel sides, and four corners and a first and a second diagonal;

two side panels, each side panel attached to one of the long parallel sides of the bottom panel, each side panel having an upwardly extending peripheral edge, each side panel having indicia printed thereon giving the appearance of two wheels spaced apart and adjacent to the bottom panel, between said wheels a number between zero and nine hundred ninety-nine and above said number, indicia depicting a window;

a top panel connected to each of the short parallel sides of the bottom panel, the top panel defining a width between the peripheral edge of each of the side panels, the top panel being connected to the edge of each of the side panels, an uppermost portion of the top panel having indicia printed there, the indicia being a number between zero and nine hundred ninety-nine, the number having a character height at least about one half the width of the top panel;

a first flexible pole extending over the tent substantially along the first diagonal of the bottom panel;

a second flexible pole extending over the tent substantially along the second diagonal of the bottom panel; and a plurality of attachments extending between the first and second flexible poles and the tent to support the tent in the shape of a car;

wherein the first flexible pole and the second flexible pole form two gentle smooth curves which when viewed from above form a flattened X; and a plurality of spaced apart side-to-side support members, the support members positioned within pockets formed in the top panel, the plurality of side-to-side support members positioned beneath individual attachments of the plurality of attachments.

9. The tent of clam 8 wherein the top panel is divided into five portions by fold lines, and wherein each fold line is connected to each of the tent poles by a strap.

10. The tent of claim 8 wherein one of the side panels has a door formed by a zipper.

11. The tent of claim 10 further comprising a screen panel positioned behind the door.

12. The tent of claim 8 wherein a portion of the top panel is constructed of screen material.

13. The tent of claim 12 further comprising a rain flap which extends down over the portion of the top panel constructed of screen material.

14. A tent simulating the appearance of an automobile, comprising:

a bottom panel, having two long parallel sides and two short parallel sides, and four corners and a first and a second diagonal;

two side panels, each side panel attached to one of the long sides of the bottom panel, each side panel having an upwardly extending peripheral edge, each side panel having indicia printed thereon, including a number between zero and nine hundred ninety-nine;

a top panel connected to each of the short parallel sides of the rectangular bottom panel, the top panel defining a width between the peripheral edge of each of the side panels, the top panel being connected to the edge of each of the side panels, an uppermost portion of the top panel having indicia printed thereon, the indicia being a number between zero and nine hundred ninety-nine, the number being identical to the number printed on the side panels;

a first flexible pole extending over the tent substantially along the first diagonal of the bottom panel;

a second flexible pole extending over the tent substantially along the second diagonal of the bottom panel;

a plurality of attachments extending between the first and second flexible poles and the tent to support the tent in the shape of a car;

wherein the first flexible pole and the second flexible pole form two gentle smooth curves which when viewed from above form a flattened X; and a plurality of spaced apart side-to-side support members, the support members positioned within pockets formed in the top panel, the plurality of side-to-side support members positioned beneath individual attachments of the plurality of attachments.

15. The tent of claim 14 wherein the top panel is divided into five portions by fold lines, and wherein each fold line is connected to each of the tent poles by a strap.

16. The tent of claim 14 wherein one of the side panels has a door formed by a zipper.

17. The tent of claim 16 further comprising a screen panel positioned behind the door.

18. The tent of claim 14 wherein a portion of the top panel is constructed of screen material.

19. A tent simulating the appearance of an automobile, comprising:

a bottom panel, having two long parallel sides and two short parallel sides, and four corners and a first and a second diagonal;

two side panels, each side panel attached to one of the long parallel sides of the bottom panel, each side panel having an upwardly extending peripheral edge, each side panel having indicia thereon giving the appearance of two wheels spaced apart and adjacent to the bottom panel, between said wheels a large number between zero and nine hundred ninety-nine and above said number, indicia depicting a window;

a top panel connected to each of the short parallel sides of the rectangular bottom panel, the top panel defining a width between the peripheral edge of each of the side panels, the top panel being connected to the edge of each of the side panels, an uppermost portion of the top panel having indicia printed thereon, the indicia being a number between zero and nine hundred ninety-nine, the number being identical to the number printed on the side panels;

a first flexible pole extending over the tent substantially along the first diagonal of the bottom panel;

a second flexible pole extending over the tent substantially along the second diagonal of the bottom panel, wherein the first flexible pole and the second flexible pole form two gentle smooth curves which when viewed from above form a flattened X; and a plurality of spaced apart side-to-side support members, the support members positioned within pockets attached to the top panel;

a plurality of attachments extending between the first and second flexible poles and the tent to support the tent in the shape of a car a door formed by a zipper in one of said two side panels.

* * * * *